US005346099A

United States Patent [19]

Salmon et al.

[11] Patent Number: 5,346,099

[45] Date of Patent: Sep. 13, 1994

[54] POUR-THROUGH STOPPER WITH HINGED LID

[76] Inventors: Pierre Salmon, Les Granges d'en Haut, Châtillon d'Azergues, France, 69380; Michel Quigrat, 2 Rue des Ecureuils, Gleizé , France, 69400

[21] Appl. No.: 103,665

[22] Filed: Aug. 10, 1993

[30] Foreign Application Priority Data

Aug. 11, 1992 [FR] France ..... 92 10066

[51] Int. Cl.[5] ..... B67B 5/00

[52] U.S. Cl. ..... 222/153; 222/498; 222/556; 220/335

[58] Field of Search ..... 222/153, 546, 556, 562, 222/498; 220/335, 337

[56] References Cited

U.S. PATENT DOCUMENTS

| | | | |
|---|---|---|---|
| 2,833,447 | 5/1958 | Thiele | 222/556 X |
| 4,666,068 | 5/1987 | Bush | 222/546 |
| 4,887,747 | 12/1989 | Ostrowsky et al. | 222/556 |
| 5,058,775 | 10/1991 | Gross et al. | 222/153 |

*Primary Examiner*—Gregory L. Huson
*Attorney, Agent, or Firm*—Dowell & Dowell

[57] ABSTRACT

A skirt of a pourer has two wings each defining a bore whose geometrical axis, which is located outside the exterior of the skirt of the pourer, is parallel to a tangent line to the skirt. Each wing has a radial cut-out whose width is less than the diameter of the corresponding bore. The bores are open in the direction of the bottom of the pourer. The lid has two opposite lugs which snap into the bores of the wings.

5 Claims, 3 Drawing Sheets

22
21a
21
24
23
20
2
1
11
13
15
15a
10
15
15b

F1
22
15
15a
1
12
15b
2
11
20
21
10
10a

Fig. 5
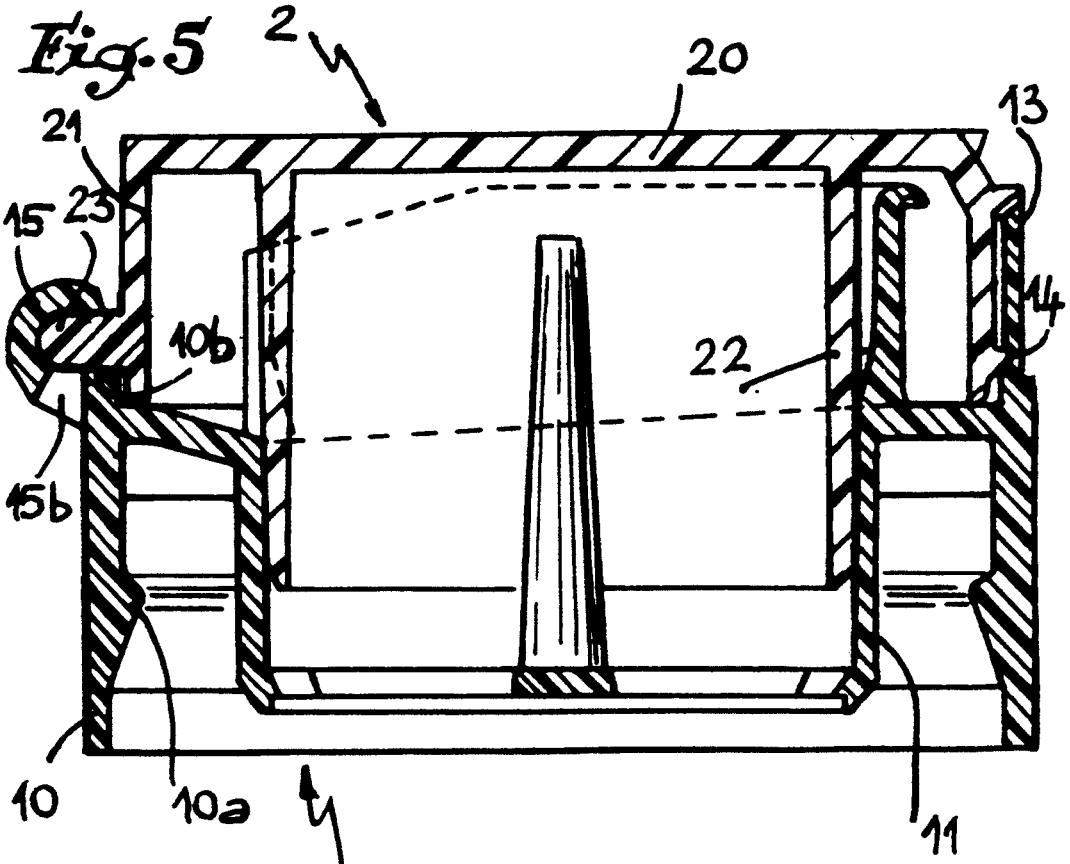
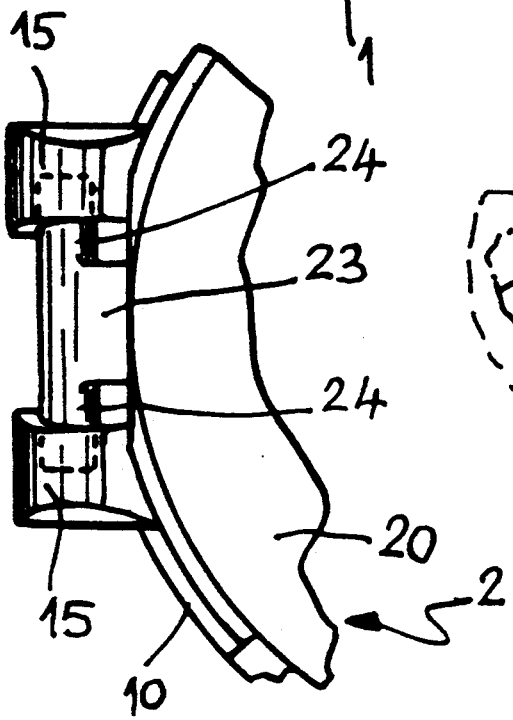
Fig. 6
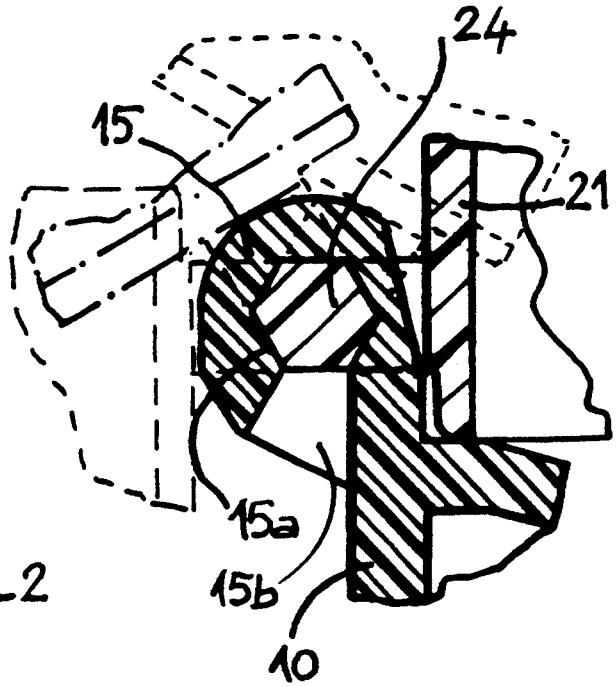
Fig. 7

POUR-THROUGH STOPPER WITH HINGED LID

BACKGROUND OF THE INVENTION

1. Field of the Invention

This invention concerns improvements made to pour-through stoppers with an inviolable safety band, fitted with a hinged lid.

2. History of the Related Art

Many pour-through stoppers of this type are known to the record, specifically those made of two pieces, i.e. in which the lid is connected to the pourer itself via a hinge created by two lateral lugs extending toward the interior from a foot that forms a single unit with the lid; these lugs click into the vertical grooves provided on the surfaces opposite a depression in the top of the pourer.

The main disadvantage of this type of pour-through stopper with lid is the fact that it is very easy to remove the lugs from their grooves by placing a knife blade or similar device into the depression of the pourer, and creating a leverage effect on the lid.

If the lid as specified above is rocked too far back when opened, there is a risk of disengaging the lugs from the grooves, and a risk of losing the lid.

SUMMARY OF THE INVENTION

The improvements that are the object of this invention are intended to remedy the disadvantages specified above, and to make it possible to create a pourer with a hinged lid that can be more rigid than the units known to date, while providing improved inviolability.

To this end, the pour-through stopper with an inviolable safety band pursuant to the invention has a pourer with two wings, each equipped with a bore whose geometrical axis, located on the outside of the exterior skirt of the pourer, is parallel to a tangent to the skirt, whereas each wing has a radial cut-out the diameter of which is less than the diameter of the corresponding bore, and which causes the bore to open in the direction of the bottom of the pourer.

BRIEF DESCRIPTION OF THE DRAWINGS

The attached drawing, submitted by way of example, will allow for a better understanding of the invention, its characteristics, and the advantages which it can provide.

FIG. 5 is a transverse section of a pour-through stopper pursuant to the invention, in the closed position.

FIG. 6 is a top view similar to that in FIG. 3, but with the lid closed.

FIG. 7 shows a different execution of the shape of the articulation of the lid with respect to the pour-through stopper.

DESCRIPTION OF THE PREFERRED EMBODIMENT

Figure 1:
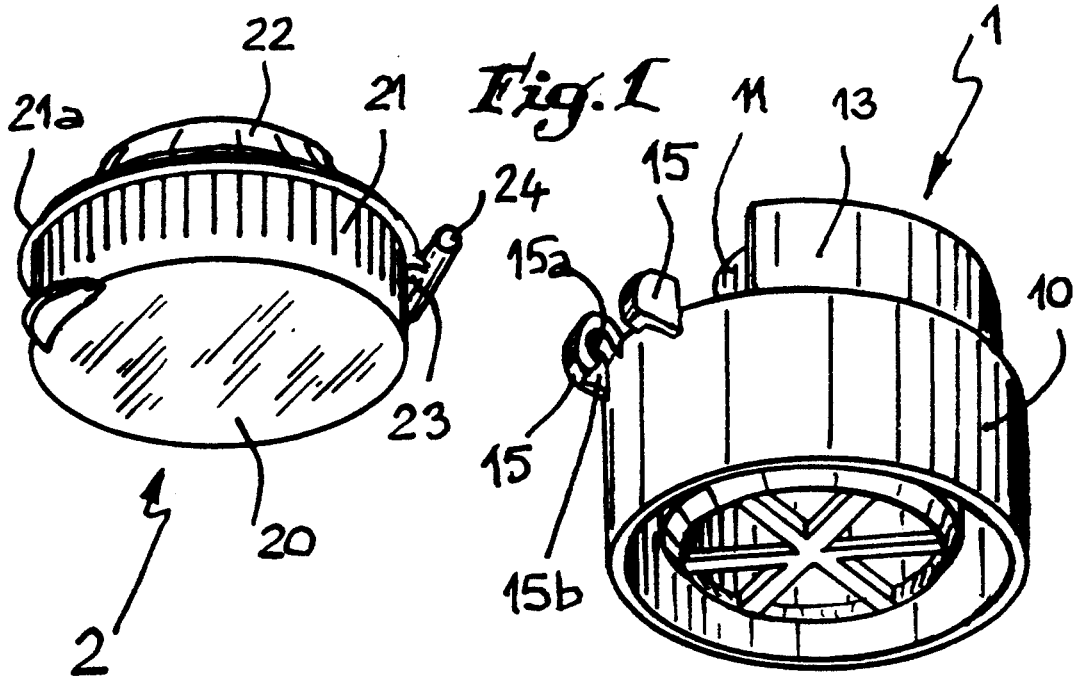
FIG. 1 is an exploded perspective view of the two parts of a pour-through stopper made in conformity with the invention.

FIG. 1 illustrates a pour-through stopper with a safety band that can be torn, pursuant to the invention, including first a pourer [1], comprising a cylindrical skirt [10] within which a flange [10*a*] is positioned (FIG. 2), which is intended to click into the neck of a container.

Inside the skirt, the pourer has a spout [11] that engages in the inside of the neck of the container, and which is connected to the skirt by a peripheral partition wall [12]. Over a large part of its edge, the upper ridge of the skirt [10] is connected to a safety band [13] that can be torn, the lower part of the internal surface of which is fitted with a groove [14] (FIG. 5). The structure of the pourer, which is well known in practice, will not be described in any further detail. Pursuant to the invention, the upper part of the outer edge of the skirt [10]is fitted with two wings [15], extending parallel to each other and to a diametrical plane of the pourer [1]. Each wing [15] has a bore [15*a*], preferably obstructed, and which opens thus onto the inside surface of the wing under consideration. Of course, the two bores [15*a*] are positioned along the same geometrical axis, which is located inside the skirt [10] parallel to a tangent to the skirt. Each wing has a radial cut-out [15*b*], the width of which is less than the diameter of the bore [15*a*]. The cut-out [15*b*] causes the bore under consideration to open in the direction of the bottom of the pourer, i.e. of its skirt [10] (see FIG. 2, in particular). Note that in that figure, each wing thus has a hollow in the form of a locking hole, comprising the bore [15*a*] and the cut-out [15*b*].

Figure 3:
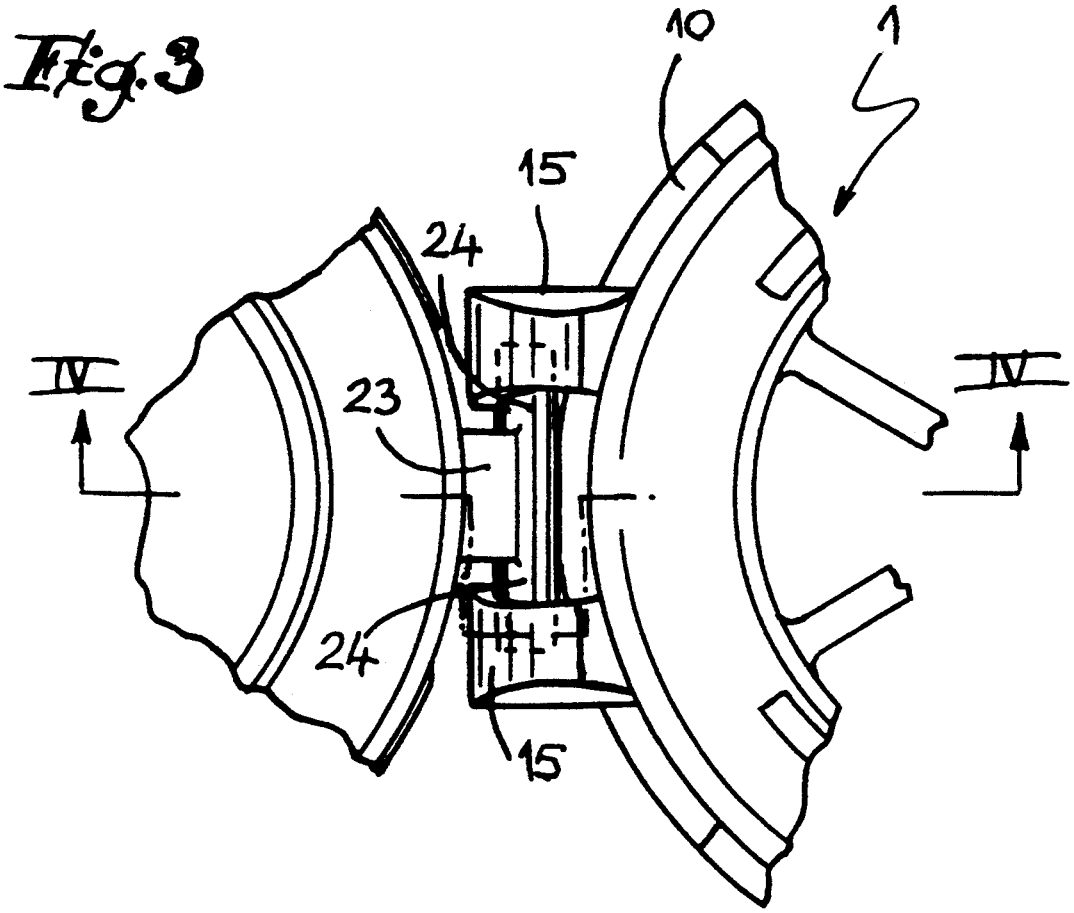
FIG. 3 is a top view of the articulation of the two parts shown in FIG. 1, after assembly, the lid being decreased to 180° with respect to its closed position.

The lid [2] intended to work with the pourer [1] is made in the usual manner. It includes a base in the form of a circular disk [20], from the edges of which extends a skirt [21], the lower part of which has an outer flange [21*a*] that works in the usual manner with the groove [14] of the safety band [13] of the pourer [1]. The lid still has a central mantle [22] that engages with the inside of the spout [11]. The edge of the skirt [21] of the lid [2] has a radial foot [23*a*] directed toward the outside, from which extend two lugs [24] located on the same geometrical axis perpendicular to the average plane of the foot [23] (FIG. 3).

Figure 2:
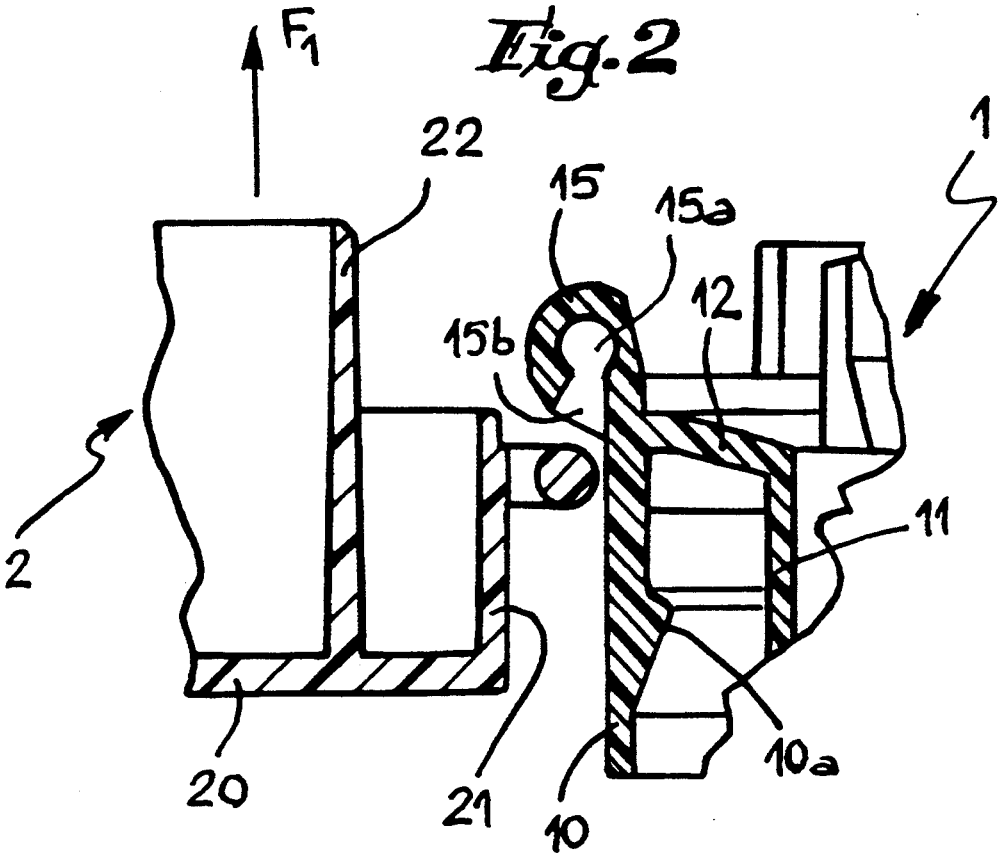
FIG. 2 is a partial transverse section of the two parts before assembly.
Figure 4:
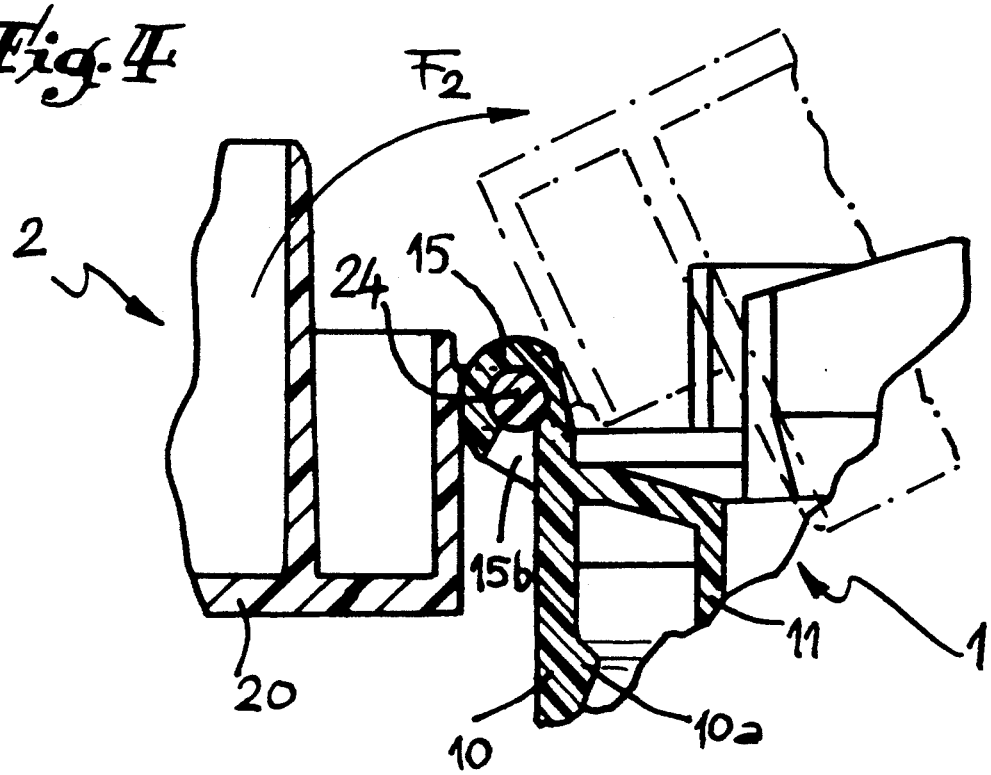
FIG. 4 is a section along IV—IV (FIG. 3).

To raise the lid with respect to the pourer, the two elements are brought together as shown in FIG. 2, the pourer being oriented as usual, whereas the lid is in the reverse position. Since the pourer is in a fixed position, the lid is displaced in the direction indicated by the arrow [F1], so that the two lugs [23] are flexibly clicked into the bores [15*a*] after they have passed by the cut-outs [15*b*] in the wings [15] of the pourer. The two elements are then in the position shogun in FIG. 4.

The lid is then made to rock in the direction indicated by the arrow [F2], to cause it to work in combination with the pourer [1], and to bring the two elements into the locking position shown in FIG. 5. Of course, to allow the lid to move back in the direction indicated by the arrow [F2], the safety band that can be torn [13] must be discontinued at the hinge and at the upper part of the spout [11].

The upper ridge [10*b*] of the skirt [10] located between the two wings [15] of the lid [1] is thus placed into close contact with the bottom of the foot [23].

FIG. 6 shows the articulation of the lid in the closed position.

FIG. 7 shows a variant of an embodiment, in which the bores [15*a*] of the wings [15] and the lugs [24] are polygonal in shape, hexagonal, for example, so that several stable angular positions of the lid can be determined with respect to the pourer.

The fact that the wings [15] actually form brackets that open toward the bottom provides improved inviolability, because it is impossible to disengage the lugs [24] outside the bores of the wings [15] when the lid is closed, even if a blade is inserted between the ridge [10*b*] of the skirt on the pourer and the foot [23] of the lid. The unit has excellent rigidity, and in addition, it is impossible to separate the lid from the cover when the lid is being opened.

In addition, it is understood that the preceding description has been provided by way of example only, and that it does not limit the scope of the invention; that scope of application is not exceeded by replacing the details of the embodiment described above by any other equivalent.

We claim:

1. In a pour-through stopper including a pourer having a generally cylindrical skirt with upper and lower edges and inner and outer surfaces, an inviolable safety band connected to the pourer and a lid having a flange for engaging the safety band, the improvement comprising, the lid having a foot member including two coaxial lugs, the pourer including two spaced wing members extending outwardly relative to the outer surface of the skirt, each of said wing members having a bore therein which is oriented generally parallel to a line tangent to the outer surface of the skirt, said bores having a maximum width dimension, each of said wing members having a cut-out therein forming an opening into said bores, said openings being oriented toward the lower edge of the skirt and being of a dimension which is smaller than said width dimension of said bores, and said lugs being engageable within said bores after being urged through said openings.

2. The pour-through stopper of claim 1 in which said bores are spaced outwardly of the outer surfaces of the skirt.

3. The pour-through stopper of claim 2 in which said bores extend only partially through said wing members.

4. The pour-through stopper of claim 3 in which said bores and said lugs have complimentary engaging surface portions.

5. The pour-through stopper of claim 4 in which said surface portions of said bores and said lugs are polygonal in configuration.

* * * * *